US010551781B2

(12) United States Patent
Isamikawa

(10) Patent No.: US 10,551,781 B2
(45) Date of Patent: Feb. 4, 2020

(54) IMAGE FORMING APPARATUS AND RECORDING MEDIUM

(71) Applicant: Konica Minolta, Inc., Tokyo (JP)

(72) Inventor: Junichi Isamikawa, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/247,659

(22) Filed: Jan. 15, 2019

(65) Prior Publication Data

US 2019/0227474 A1 Jul. 25, 2019

(30) Foreign Application Priority Data

Jan. 19, 2018 (JP) ..... 2018-007168

(51) Int. Cl.
*G03G 15/00* (2006.01)

(52) U.S. Cl.
CPC ..... *G03G 15/55* (2013.01); *G03G 15/5062* (2013.01)

(58) Field of Classification Search
CPC ..... G03G 15/55; G03G 15/5062; H04N 1/00002; H04N 1/00031
See application file for complete search history.

(56) References Cited

U.S. PATENT DOCUMENTS

2011/0052224 A1* 3/2011 Yamashina ..... G03G 15/55 399/33
2017/0123352 A1* 5/2017 Ebihara ..... G03G 15/553
2019/0174013 A1* 6/2019 Yamanaka ..... G03G 15/5062

FOREIGN PATENT DOCUMENTS

JP 2005125633 A 5/2005
JP 200762288 A 3/2007

* cited by examiner

*Primary Examiner* — Sophia S Chen
(74) *Attorney, Agent, or Firm* — Buchanan Ingersoll & Rooney PC

(57) ABSTRACT

An image forming apparatus includes a plurality of types of parts, and forms an image on a sheet using the plurality of parts. The apparatus includes the following. An image former forms the image on the sheet. An image reader reads image data of the sheet on which the image is formed. A hardware processor detects an image abnormality from the read image data, specifies a target part for diagnosis from the plurality of parts based on the detected image abnormality, calculates a deterioration degree of the specified target part, and diagnoses whether the target part is a cause for the detected image abnormality based on the calculated deterioration degree.

10 Claims, 6 Drawing Sheets

FIG.4A

T1

| T11 NUMBER | T12 IMAGE ABNORMALITY TYPE | T13 ABNORMALITY CONTENTS |
|---|---|---|
| 1 | PERIODIC WHITE SPOTS/ BLACK SPOTS | WHITE SPOTS OR BLACK SPOTS OCCUR AT A CERTAIN CYCLE |
| 2 | WHITE FIREFLY-LIKE SPOT | A ROUND WHITE SPOT IN A FILLED AREA WITH A BLURRED OUTLINE THAT LOOKS LIKE A GLOWING FIREFLY |
| 3 | FD DIRECTION STREAK | STREAK GENERATED IN FD DIRECTION IS OUTPUT |
| 4 | CD DIRECTION STREAK | STREAK GENERATED IN CD DIRECTION IS OUTPUT |
| 5 | SCATTERED TONER/ TONER STAIN | ABNORMALITY OF IMAGE STAIN FROM SCATTERED TONER DUE TO DETERIORATION OF TONER IN DEVELOPER |

FIG.4B

T2

| T21 NUMBER | T22 TARGET PARTS | T23 ABNORMALITY DETERMINATION METHOD |
|---|---|---|
| 1 | PHOTORECEPTOR DRUM | CYCLE OF ABOUT 251 mm WITH SINGLE COLOR |
| 2 | DEVELOPER | CYCLE OF ABOUT 43.5 mm WITH SINGLE COLOR |
| 3 | INTERMEDIATE TRANSFER BELT | CYCLE OF ABOUT 1066 mm. OCCURS EVERY THREE SHEETS IN A3 SINGLE SIDE OUTPUT |
| 4 | SECONDARY TRANSFER BELT | CYCLE OF ABOUT 195 mm |
| 5 | PRIMARY TRANSFER ROLLER | CYCLE OF ABOUT 70 mm |
| 6 | SECONDARY TRANSFER ROLLER Up | CYCLE OF ABOUT 120 mm |
| 7 | SECONDARY TRANSFER ROLLER Lw | CYCLE OF ABOUT 120 mm |
| 8 | INTERMEDIATE TRANSFER ROLLER | CYCLE OF ABOUT 120 mm |
| 9 | FIXING BELT | CYCLE OF ABOUT 377 mm. OCCURS ON SURFACE IN SINGLE SIDE PRINTING |
| 10 | FIXING ROLLER | CYCLE OF ABOUT 182 mm. OCCURS ON SURFACE IN SINGLE SIDE PRINTING |
| 11 | PRESSURING ROLLER | CYCLE OF ABOUT 220 mm. OCCURS ON SURFACE IN SINGLE SIDE PRINTING |

FIG.4C

T3

| T31 NUMBER | T32 IMAGE ABNORMALITY TYPE | T33 TEST DIAGNOSIS METHOD |
|---|---|---|
| 1 | PERIODIC WHITE SPOTS/ BLACK SPOTS | OUTPUT TEST CHART WITH CHANGED PARAMETER AND CONFIRM DEGREE OF IMPROVEMENT |
| 2 | CD DIRECTION SHINY STREAK | REDUCE FIXING TEMPERATURE OF COATED SHEET FIVE DEGREES AT A TIME, RAISE FIXING TEMPERATURE OF NON-COATED SHEET FIVE DEGREES AT A TIME,AND CONFIRM DEGREE OF IMPROVEMENT |
| 3 | FD DIRECTION STREAK DUE TO PHOTORECEPTOR DRUM | PERFORM PHOTORECEPTOR REFRESH MODE AND CONFIRM IMPROVEMENT |

FIG. 6

| NUMBER | PART | DETERIORATION DEGREE | DIAGNOSIS ORDER | DIAGNOSIS |
|---|---|---|---|---|
| 1 | DRUM UNIT | 50 | 3 | |
| 2 | DEVELOPER | 30 | 4 | |
| 3 | INTERMEDIATE TRANSFER BELT | 20 | 5 | |
| 4 | SECONDARY TRANSFER BELT | 70 | 2 | |
| 5 | SECONDARY TRANSFER ROLLER Up | 90 | 1 | NG |

FIG. 7A

PRIOR ART

| NUMBER | PART | DIAGNOSIS |
|---|---|---|
| 1 | DRUM UNIT | NG |
| 2 | DEVELOPER | |
| 3 | INTERMEDIATE TRANSFER BELT | |
| 4 | SECONDARY TRANSFER BELT | |
| 5 | SECONDARY TRANSFER ROLLER Up | |

FIG. 7B

PRIOR ART

| NUMBER | PART | DIAGNOSIS |
|---|---|---|
| 1 | DRUM UNIT | OK |
| 2 | DEVELOPER | OK |
| 3 | INTERMEDIATE TRANSFER BELT | OK |
| 4 | SECONDARY TRANSFER BELT | OK |
| 5 | SECONDARY TRANSFER ROLLER Up | NG |

IMAGE FORMING APPARATUS AND RECORDING MEDIUM

BACKGROUND

Technological Field

The present invention relates to an image forming apparatus and a recoding medium.

Description of the Related Art

Conventionally, there is an image forming apparatus such as an electro-photographic type multifunctional printer which forms an image on a sheet using toner. The image forming apparatus includes a plurality of parts, and the part which is the reason for the abnormal state is diagnosed as a diagnosis for trouble. When it is determined that there is a failure, maintenance is performed.

There is also a multifunctional printer which reads an actually printed test image with a scanner to diagnose abnormal states in units (parts) composing the printer according to the abnormal state of the read image (Japanese Patent Application Laid-Open Publication No. 2005-125633).

There is also a failure diagnosis system which uses a failure diagnosis model in which a failure reason (parts) is linked with lines to input information having a relation of cause and effect with the failure reason (parts) and applying an input priority according to a degree of influence in fault diagnosis. In such system, the failure diagnosis for the failure reason is performed by obtaining input information in order from those with high priority (Japanese Patent Application Laid-Open Publication No. 2007-62288). Input information with more linking lines to failure reasons has a higher input order priority.

In failure diagnosis, in order to specify the part which is the cause of the abnormal image among the plurality of parts, the condition is changed for each part (for example, changing charge voltage of a charging unit) and a test image is printed to specify the part from the change in the image.

However, in conventional failure diagnosis, when the part causing the abnormal state is specified, the degree of deterioration is not considered. FIG. 7A is a diagram showing a table of order of diagnosing conventional parts in one example of a diagnosis. FIG. 7B is a diagram showing a table of order of diagnosing conventional parts with the same diagnosis order as FIG. 7A in a different example in which the abnormal part is different. In FIG. 7A and FIG. 7B, the numbers in the parts show the order of diagnosis.

When the failure diagnosis is performed in the order of the table shown in FIG. 7A, it is possible to specify the cause in the beginning of the diagnosis when the drum unit has a large degree of deterioration and fails. However, as shown in FIG. 7B, when the secondary transfer roller Up (upper side) has a large degree of deterioration and fails, time is necessary to specify the part which causes the abnormal state, and the down time of the image forming apparatus increases.

SUMMARY

The object of the present invention is to provide an image forming apparatus which is able to decrease time necessary to find a part which causes an abnormality in an image.

To achieve at least one of the abovementioned objects, according to an aspect of the present invention, an image forming apparatus reflecting one aspect of the present invention is described, an image forming apparatus which includes a plurality of types of parts, and which forms an image on a sheet using the plurality of parts, the apparatus including: an image former which forms the image on the sheet; an image reader which reads image data of the sheet on which the image is formed; and a hardware processor which detects an image abnormality from the read image data, specifies a target part for diagnosis from the plurality of parts based on the detected image abnormality, calculates a deterioration degree of the specified target part, and diagnoses whether the target part is a cause for the detected image abnormality based on the calculated deterioration degree.

According to a second aspect of the present invention, a non-transitory computer-readable recording medium includes a program stored thereon for controlling a computer used in an image forming apparatus which includes a plurality of types of parts, and which forms an image on a sheet using the plurality of parts, the program controlling the computer to function as: an image former which forms the image on the sheet; an image reader which reads image data of the sheet on which the image is formed; and a hardware processor which detects an image abnormality from the read image data, specifies a target part for diagnosis from the plurality of parts based on the detected image abnormality, calculates a deterioration degree of the specified target part, and diagnoses whether the target part is a cause for the detected image abnormality based on the calculated deterioration degree.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 4A is a diagram showing an image abnormality table.

FIG. 4B is a diagram showing a parts table.

FIG. 4C is a diagram showing a test diagnosis table.

FIG. 6 is a diagram showing a table of one example of diagnosis, the table showing an order of diagnosis of parts according to an embodiment of the present invention.

FIG. 7A is a diagram showing a table of an example of diagnosis, the table showing a conventional order of diagnosis of parts.

FIG. 7B is a diagram showing a table of another example of diagnosis in which the abnormal part is different from FIG. 7A, the table showing an order of diagnosis of parts similar to that of FIG. 7A.

DETAILED DESCRIPTION OF EMBODIMENTS

Hereinafter, one or more embodiments of the present invention will be described with reference to the drawings. However, the scope of the invention is not limited to the disclosed embodiments.

The embodiments of the present invention are described in detail with reference to the drawings.

Figure 1:
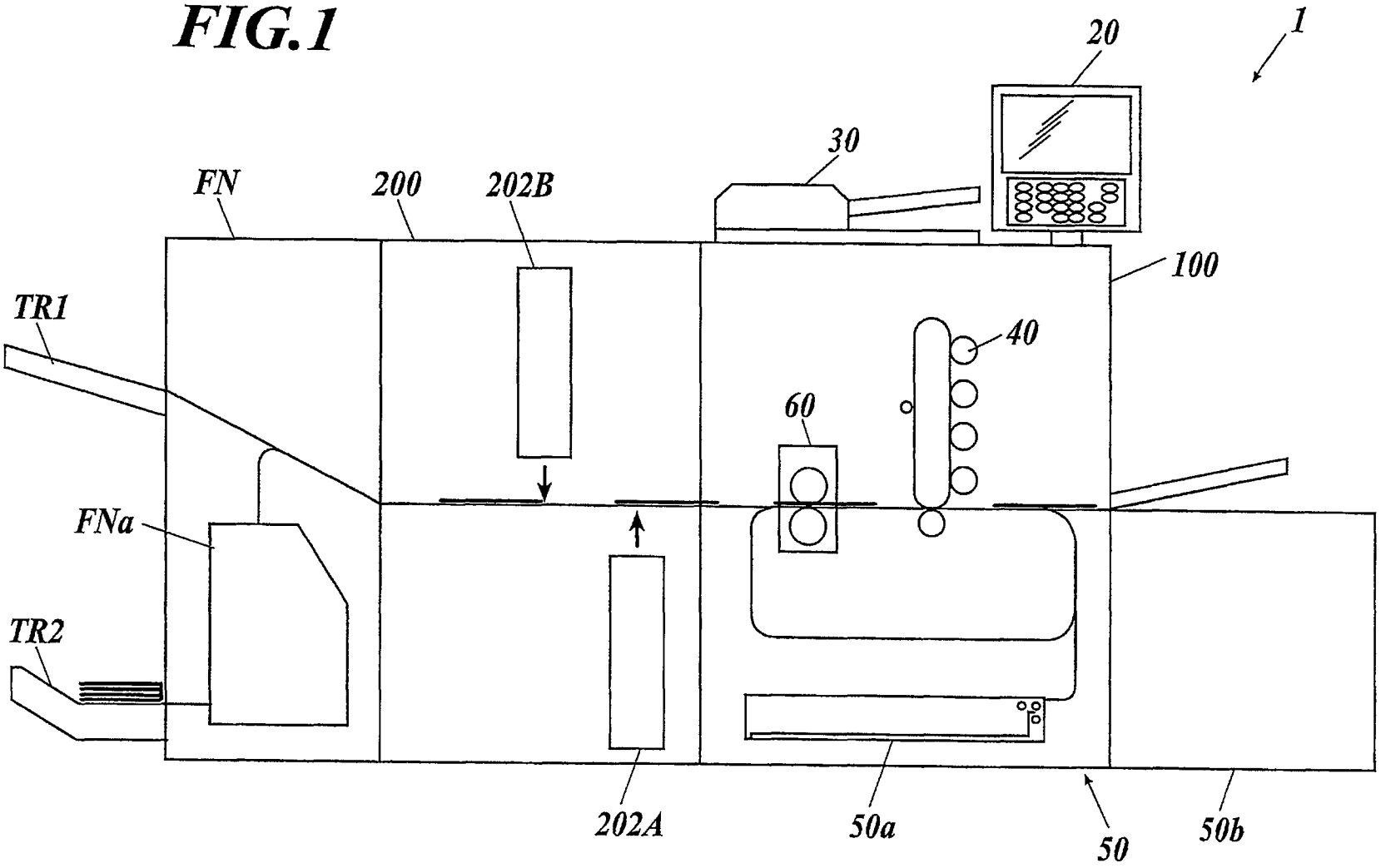
FIG. 1 is a schematic diagram showing a schematic configuration of an image forming apparatus according to an embodiment of the present invention.

First, the configuration of the apparatus according to the present embodiment is described with reference to FIG. 1 to FIG. 3. FIG. 1 is a diagram showing a schematic configuration of the image forming apparatus 1 according to a present embodiment.

As shown in FIG. 1, the image forming apparatus 1 forms an image on a sheet by an electro-photographic method. The image forming apparatus 1 is a color image forming apparatus employing a tandem method which overlaps toners in four colors, yellow (Y), magenta (M), cyan (C), and black (K).

As shown in FIG. 1, the image forming apparatus 1 includes an image forming apparatus main body 100, an image reading apparatus 200, and a finisher FN connected in series with the image reading apparatus 200 as an image reader.

The image forming apparatus main body 100 is the main body which forms an image on a sheet. The image forming apparatus main body 100 includes an operation/display unit 20, a scanning unit 30, an image former 40 as the image forming unit, a fixer 60, and a sheet feeder 50. The internal configuration of the image forming apparatus main body 100 is described later.

The image reading apparatus 200 is an apparatus which reads the sheet output from the image forming apparatus main body 100 with the image formed, and feeds the result back to the image forming apparatus main body 100. The image reading apparatus 200 includes image readers 202A, 202B. The image reader 202A is provided on a conveying path of the sheet downstream of the image forming apparatus main body 100. The image reader 202A reads the image of one surface (for example, rear surface) of the sheet and obtains image data. The image reader 202B is provided on a conveying path of the sheet downstream of the image reader 202A. The image reader 202B reads the image of the other surface (for example, front surface) of the sheet and obtains image data. For example, the image readers 202A, 202B are color sensors which receive light emitted from a light source and reflected on the surface of the sheet and output a signal according to a strength of the light. The image readers 202A, 202B can be configured by a line sensor in which a plurality of light receiving elements are positioned at a predetermined interval in a direction orthogonal to a sheet conveying direction, or can be configured to read only a predetermined region in a direction orthogonal to the sheet conveying direction.

The finisher FN is an apparatus which performs a saddle stitching process when necessary on sheet output from the image reading apparatus 200, and includes a saddle stitching unit FNa. Specifically, when the saddle stitching process is not set in the print job, the finisher FN does not perform the saddle stitching process on the conveyed sheet and ejects the sheet as is to a sheet ejecting tray TR1. When the saddle stitching process is set in the print job, the saddle stitching unit FNa performs the saddle stitching process on the conveyed sheet and the finisher FN ejects the bound sheets (book) to a sheet ejecting tray TR2.

The finisher FN does not have to be provided in the image forming apparatus 1, and a finishing apparatus which is able to perform finishing processes other than the saddle stitching process such as a case binding process, a multi-hole punching process, or a creasing process which adds a crease to the sheet can be provided in the image forming apparatus 1.

The configuration of the image forming apparatus main body 100 is described with reference to FIG. 2. FIG. 2 is a diagram showing an internal configuration of the image forming apparatus main body 100.

Figure 2:
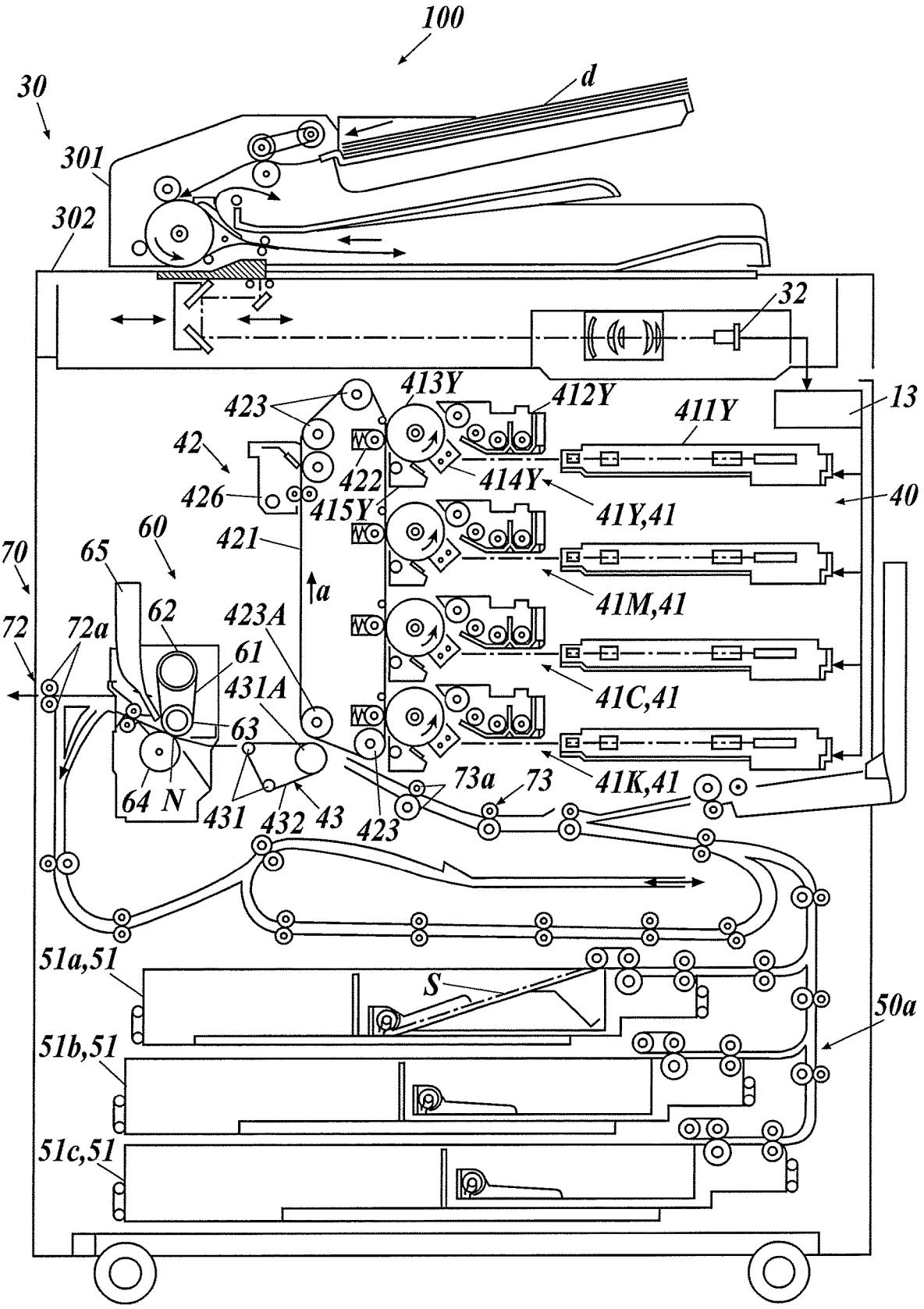
FIG. 2 is a diagram showing an internal configuration of a main body of the image forming apparatus.

As shown in FIG. 2, the image former 40 includes image forming units 41Y, 41M, 41C, and 41K which form an image using toner in various colors such as YMCK according to control by a later described image control CPU (Central Processing Unit) 11. The above image forming units 41Y, 41M, 41C, and 41K have the same configuration other than the stored toner, and thus the sign showing the color may be omitted in the description below. The image former 40 includes an intermediate transfer unit 42 and a secondary transfer unit 43.

The image forming unit 41 includes an exposer 411, a developer 412, a photoreceptor drum 413, a charger 414, and a drum cleaner 415. The photoreceptor drum 413 may be, for example, a negative charge type organic photoreceptor. The surface of the photoreceptor drum 413 is photoconductive. The charger 414 may be, for example, a corona charger. The charger 414 can be a contact charging apparatus which charges by contacting a contact charged member such as a charged roller, charged brush, or a charged blade with the photoreceptor drum 413. The exposer 411 includes, for example, a LD (Laser Diode) 411*a* which outputs a laser beam as a light source and an optical deflecting apparatus (polygon motor) which emits a laser beam to the photoreceptor drum 413 according to the image to be formed.

The developer 412 is a developing apparatus in a two component developing format. For example, the developer 412 includes a developing container including a two-component developing material, a developing roller (magnetism roller) provided to be rotatable in an opening of the developing container, a partition which divides the inside of the developing container in a way that the two-component developing material is communicable, a conveying roller which conveys the two-component developing material in an opening side of the developing container to the developing roller, and a stirring roller which stirs the two-component developing material in the developing container. The developing container stores the toner as the two-component developing material.

The intermediate transfer unit 42 includes a primary transfer roller 422 which pressure contacts the intermediate transfer belt 421 to the photoreceptor drum 413, a plurality of supporting rollers 423 which include a secondary transfer roller Up (backup roller) 423A, and a belt cleaner 426. The intermediate transfer belt 421 is stretched in a loop around the plurality of supporting rollers 423. At least one of the driving rollers of the plurality of supporting rollers 423 rotates so that the intermediate transfer belt 421 runs at a certain speed in an arrow "a" direction.

The secondary transfer unit 43 includes a plurality of supporting rollers 431 including an endless secondary transfer belt 432 and a secondary transfer roller Lw (lower side) 431A. The secondary transfer belt 432 is stretched in a loop around the secondary transfer roller Lw 431A and the supporting roller 431.

According to the control by the later described image control CPU 11, the fixer 60 heats and pressures the sheet on which the image former 40 formed the toner image. The fixer 60 includes an endless fixing belt 61 which is a heating member, a heating roller 62, a fixing roller 63 which is positioned facing a pressuring roller 64, the pressuring roller 64, and an air separator 65. The fixing belt 61 is stretched around the heating roller 62 and the fixing roller 63. The heating roller 62 is internally provided with a heating unit such as a halogen heater (not shown) which heats the fixing belt 61. The fixing roller 63 forms a nip N between the fixing belt 61 and the pressuring roller 64.

As described above, when the pressuring roller 64 is rotated in the counter clockwise direction by the driver (not shown), the fixing belt 61, the heating roller 62, and the fixing roller 63 rotate in the clockwise direction. The fixing belt 61 in contact with the heating roller 62 is heated and the fixing roller 63 is also heated. Then, the sheet on which the toner image is formed passes the nip N and is heated and pressured so that the toner image transferred on the sheet is melted and fixed.

The air separator 65 sends air to the sheet ejected from the nip N to separate the sheet from the fixing belt 61. The air separator 65 includes a suction fan (not shown) which sucks air from outside and sends the air in the direction of the nip N, and a duct which is the path of the sent air. By separating the sheet from the fixing belt 61 using the air separator 65, the sheet can be separated without contacting a member such as a separating piece to the surface of the fixing belt 61. Therefore, the surface of the fixing belt 61 is not damaged.

The image forming apparatus main body 100 includes the scanning unit 30, a reading processor 13, the sheet feeder 50, and the sheet conveyor 70. The scanning unit 30 includes a sheet feeding apparatus 301 and a scanner 302. According to control by the later-described image control CPU 11, the scanning unit 30 feeds a document d with the sheet feeding apparatus 301, scans the document d with the CCD (Charge Coupled Device) sensor 32 of the scanner 302, and obtains input image data. The sheet feeder 50 includes sheet feeders 50*a*, 50*b*. According to the control by the later-described image control CPU 11, the sheet feeder 50 feeds the sheet S to the image former 40. The sheets S (standard sheet, special sheet) discriminated based on basis weight and size are stored in advance according to the set type in the three sheet feeding tray units 51*a*, 51*b*, and 51*c* which compose the sheet feeder 50*a* and the external sheet feeder 50*b*.

The sheet conveyor 70 includes a sheet ejector 72 and a conveying path 73. According to control by the later-described image control CPU 11, the sheet conveyor 70 conveys the sheet S to the image former 40 using the sheet conveying path 73 and ejects the sheet S from the fixer 60 using the sheet ejector 72. The conveying path 73 includes a plurality of pairs of conveying rollers such as a registration roller pair 73*a*. The sheet conveyor 70 includes an inverting path which inverts the sheet on which an image is formed on one surface and which conveys the sheet to the image former 40 again.

Here, an example of an image forming method by the image forming apparatus main body 100 is described. The scanner 302 optically scans and reads the document d fed on the contact glass by the sheet feeding apparatus 301 or placed on the platen glass. The light reflected from the document d is read by the CCD sensor 32 of the scanner 302 and this is to be the input image data. Predetermined image processing is performed on the input image data in the reading processor 13 and sent to the exposer 411.

The photoreceptor drum 413 rotates at a certain circumferential speed. The charger 414 charges the entire surface of the photoreceptor drum 413 to a negative polarity. The exposer 411 rotates the polygon mirror of the polygon motor at a high speed, and the laser beam corresponding to the input image data of each color component is developed along the axis direction of the photoreceptor drum 413 to be irradiated on the outer circumferential surface of the photoreceptor drum 413 along the axis direction. With this, the electrostatic latent image is formed on the surface of the photoreceptor drum 413.

In the developer 412, toner particles are charged by stirring and conveying of the two-component developing material in the developing container, the two-component developing material is conveyed to the developing roller, and the magnetism brush is formed on the surface of the developing roller. The charged toner particles are attached electrostatically to the portion of the electrostatic latent image in the photoreceptor drum 413 from the magnetism brush. With this, the electrostatic latent image on the surface of the photoreceptor drum 413 becomes visible, and the toner image according to the electrostatic latent image is formed on the surface of the photoreceptor drum 413.

The toner image on the surface of the photoreceptor drum 413 is transferred on the intermediate transfer belt 421 using the intermediate transfer unit 42. The transfer remaining toner remaining on the surface of the photoreceptor drum 413 after transfer is removed by the drum cleaner 415 including the drum cleaning blade which slides against the surface of the photoreceptor drum 413.

The primary transfer roller 422 is used so that the intermediate transfer belt 421 pressure contacts the photoreceptor drum 413, and the photoreceptor drum 413 and the intermediate transfer belt 421 form the primary transfer nip for each photoreceptor drum. The primary transfer nip transfers toner images of each color sequentially overlapped on the intermediate transfer belt 421.

The secondary transfer roller Lw 431A is pressure contacted with the secondary transfer roller Up 423A through the intermediate transfer belt 421 and the secondary transfer belt 432. With this, the secondary transfer nip is formed with the intermediate transfer belt 421 and the secondary transfer belt 432. The sheet S passes the secondary transfer nip. The sheet conveyor 70 conveys the sheet S to the secondary transfer nip. The registration roller unit in which the registration roller pair 73*a* are provided corrects the tilt of the sheet S and adjusts the timing of conveying the sheet S.

When the sheet S is conveyed to the secondary transfer nip, the transfer bias is applied to the secondary transfer roller Lw 431A. By applying the transfer bias, the toner image held by the intermediate transfer belt 421 is transferred to the sheet S. The sheet S in which the toner image is transferred is conveyed by the secondary transfer belt 432 to the fixer 60.

The fixer 60 forms a nip N with the fixing belt 61 and the pressuring roller 64, and the conveyed sheet S is heated and pressured at the nip N. The toner particles composing the toner image on the sheet S are heated and crystalline resin inside melt quickly. As a result, the entire toner particle melts quickly with a relatively small amount of heat, and the toner components are attached to the sheet S. With this, the toner image is fixed to the sheet S quickly with a relatively small amount of heat. The sheet S with the toner image fixed is ejected to the image reading apparatus 200 by the sheet ejector 72 including the sheet ejecting roller 72*a* of the sheet conveyor 70. With this, an image with high quality is formed.

The residual toner remaining on the surface of the intermediate transfer belt 421 after the secondary transfer is removed by the belt cleaner 426 including the belt cleaning blade which slides against the surface of the intermediate transfer belt 421.

Next, the functional configuration of the image forming apparatus 1 is described with reference to FIG. 3. FIG. 3 is a block diagram showing a functional configuration of the image forming apparatus 1.

The image forming apparatus main body 100 forms a color image with the electro-photographic method based on image data obtained by reading the image from a document or image data received from an external apparatus 2. The image forming apparatus main body 100 includes a main body unit 100*a* and a print controller 100*b*. The image forming apparatus main body 100 is connected to the external apparatus 2 on the network through the LAN IF (Local Area Network Interface) 82 of the print controller 100*b* so as to be able to transmit and receive information between each other.

The main body unit 100*a* includes the main body controller 10, the operation/display unit 20, the scanner unit 30, and the image former 40.

The main body controller 10 includes an image control CPU 11 as an abnormality detecting unit, a parts specifying unit, a deteriorating degree calculating unit and a diagnostic unit, a nonvolatile memory 12, a reading processor 13, a compression IC (Integrated Circuit) 14, a DRAM (Dynamic Random Access Memory) control IC 15, an image memory 16, a decompression IC 17 and a writing processor 18.

Based on the operation signal output from the operation/display unit 20, the image control CPU 11 reads various programs stored in the nonvolatile memory 12 and deploys the above in the RAM (not shown), and executes the various processes in coordination with the deployed programs to control each unit of the image forming apparatus 1. The nonvolatile memory 12 includes a nonvolatile semiconductor memory in which data can be read and written, and various programs and various data regarding the image forming apparatus 1 are stored. Specifically, the nonvolatile memory 12 stores the following, later described image abnormality table T1, parts table T2, test diagnosis table T3, test diagnosis improvement percentage A, count value counting use of part, limit value, trouble occurring count C, trouble occurring coefficient D, and test diagnosis program.

The reading processor 13 performs an analog process, a shading process, an A/D (Analog to Digital) conversion process and the like on the analog image signal output from the scanner unit 30 (CCD sensor 32), and the digital image data is generated. The reading processor 13 outputs the generated image data to a compression IC 14. After the compression process is performed on the image data output from the reading processor 13, the compression IC 14 outputs the image data to a DRAM control IC 15.

Based on the control by the image control CPU 11, the DRAM control IC 15 controls a compression process of image data by the compression IC 14 and a decompression process of the compressed image data by the decompression IC 17 and controls input/output of image data between the image memory 16. For example, when the storage of the image data read by the scanner unit 30 is instructed, the DRAM control IC 15 controls the compression IC 14 to perform the compression process of the image data output from the reading processor 13 and to store the compressed image data in the compression memory 16*a* of the image memory 16. When the print output of the compressed image data stored in the compression memory 16*a* is instructed, the DRAM control IC 15 reads out the compressed image data from the compression memory 16*a*, and controls the decompression IC 17 to perform the decompression process and to store the data in the page memory 16*b*. The DRAM control IC 15 reads out the non-compressed image data from the page memory 16*b* and outputs the data to the writing processor 18.

The image memory 16 is composed of a DRAM and is provided with a compression memory 16*a* and a page memory 16*b*. The compression memory 16*a* stores the compressed image data. The page memory 16*b* temporarily stores non-compressed image data as the target of printing before forming the image.

The decompression IC 17 outputs the image data to the DRAM control IC 15 after performing the decompression process on the compressed image data read from the compression memory 16*a*. Based on the image data as the target of printing output from the DRAM control IC 15, the writing process 18 generates the print image data to form the image and outputs the data to the image former 40.

The operation/display unit 20 is provided with an operation/display controller 21, and a LCD (Liquid Crystal Display) 22. The operation/display controller 21 performs control of the display on the LCD 22 based on the instruction from the image control CPU 11 and also outputs to the image control CPU 11 the operation signal generated by the user pressing the operation keys or the touch panel (not shown). The LCD 22 is provided with a touch panel provided to cover the LCD 22 and displays on the screen the various setting screens according to the instruction of the display signal output from the operation/display controller 21, state of the image, and state of operation of each function.

The scanner unit 30 includes a scanner controller 31 which drives and controls the CCD sensor 32 and the CCD sensor 32. The scanner unit 30 exposes and scans with a light source the document surface of the document d fed on the contact glass by the sheet feeding apparatus 301 or placed on the platen glass. The scanner unit 30 receives the reflected light from the document surface, photo-electrically converts the received reflected light with the CCD sensor 32, and generates the analog image signal. The scanner unit 30 outputs the generated analog image signal to the reading processor 13.

The image former 40 includes a printer controller 401 and various units such as the exposer 411 including the LD 411*a*. The printer controller 401 controls operations of each unit in the image former 40 based on the instruction by the image control CPU 11. For example, the printer controller 401 forms the image on the sheet based on the print image data output from the writing processor 18.

Figure 3:
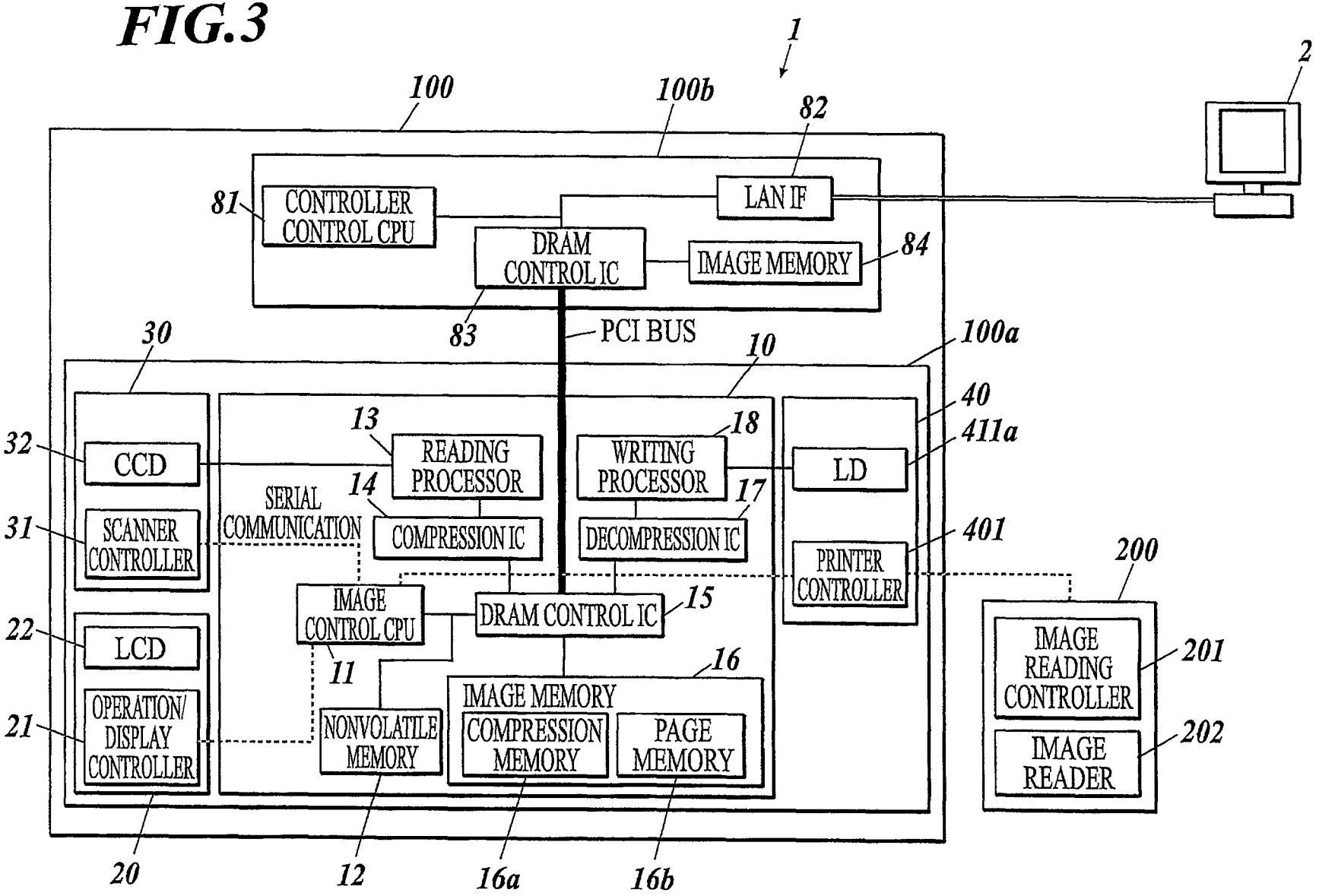
FIG. 3 is a block diagram showing a functional configuration of the image forming apparatus.

Although illustration is omitted in FIG. 3, the sheet feeder 50, the fixer 60, and the sheet conveyor 70 are connected to the image control CPU 11. The sheet feeder 50, the fixer 60, and the sheet conveyor 70 feeds the sheet S, heats and pressures the sheet S on which the image is formed, and conveys the sheet S based on control by the image control CPU 11.

When the image forming apparatus 1 is used as a network printer, the print controller 100*b* manages and controls the print job output from the external apparatus 2 connected to the network to the image forming apparatus 1. The print controller 100*b* receives the data as the print target from the external apparatus 2, and transmits the data as the print job data to the main body unit 100*a*. The print controller 100*b* includes a controller control CPU 81, a LANIF 82, a DRAM control IC 83, and an image memory 84.

The controller control CPU 81 centrally controls the operation of each unit in the print controller 100*b* and outputs the image data output from the external apparatus 2 through the LANIF 82 as the print job to the main body unit 100*a*.

The LANIF 82 is a communication interface to connect with a LAN such as a NIC (Network Interface Card) or modem, and receives the image data as the print target through the network from the external apparatus 2. The LANIF 82 outputs the received image data to the DRAM control IC 83.

The DRAM control IC 83 controls storing the image data received through the LANIF 82 in the image memory 84 and readout of the image data from the image memory 84. The DRAM control IC 83 is connected with the DRAM control IC 15 of the main body controller 10 of the main body unit 100*a* by a PCI (Peripheral Components Interconnect) bus. According to an instruction from the controller control CPU 81, the image data as the print target is read out from the image memory 84 and the data is output to the DRAM control IC 15.

The image memory 84 is composed of a DRAM and temporarily stores the input image data.

The external apparatus 2 generates the data of the print job printed by user operation and transmits the above to the image forming apparatus 1 through the network. As the external apparatus 2, for example, a PC (Personal Computer) or server apparatus, or a portable device such as a tablet PC can be applied.

The image reading apparatus 200 is provided with an image reading controller 201 and an image reader 202. The image reading controller 201 centrally controls operation of each unit of the image reading apparatus 200, and the image data read by the image reader 202 is output to the image control CPU 11 through the printer controller 401. The image reader 202 includes image readers 202A, 202B. The image reader 202 reads the image on the sheet S on which an image is formed by the image former 40 and the image is fixed by the fixer 60, and the read image data is output to the image reading controller 201.

Although illustration is omitted in FIG. 3, the finisher FN is connected to the image control CPU 11 through the image reading controller 201. According to control by the image control CPU 11, the finisher FN performs the finishing process such as saddle stitching on the sheets S input from the image reading apparatus 200 and ejects the sheet.

Next, with reference to FIG. 4A to FIG. 4C, the information stored in the nonvolatile memory 12 is described. FIG. 4A is a diagram showing an image abnormality table T1. FIG. 4B is a diagram showing a parts table T2. FIG. 4C is a diagram showing a test diagnosis table T3.

As shown in FIG. 4A, the image abnormality table T1 is a table showing contents of abnormalities in images abnormalities among abnormalities which occur when an image is formed on the sheet S. There are three types of abnormalities which occur when the image is formed on the sheet S, specifically, image abnormality, sheet defect, and trouble occurrence, but the present invention is not limited to the above.

The image abnormality is an abnormality detected from the image of the sheet S read by the image reading apparatus 200. Such abnormality include, periodic white spots/black spots, firefly-like white spot (a round white spot in a filled area with a blurred outline that looks like a glowing firefly), streak in a feed direction (FD: sheet conveying direction), streak in a cross direction (CD: direction orthogonal to sheet conveying direction), scattered toner/toner stain in machine, and the like. The sheet defect is an abnormality in the sheet, and such abnormality occurs due to wave/curl in sheet, wrinkle of sheet in rear edge, folded corner when image is formed on both surfaces, and the like. Trouble occurrence occurs due to an error code (for example, error related to fixer 60 such as the air separator 65).

The image abnormality table T1 includes items such as number T11, image abnormality type T12, and abnormality contents T13. The number T11 shows identification information of the record of the image abnormality table T1. The image abnormality type T12 shows a type of image abnormality corresponding to the number T11. For example, the image abnormality type T12 includes, periodic white spots/black spots, firefly-like white spot, streak in a feed direction, streak in a cross direction, scattered toner/toner stain in machine, and the like. The abnormality contents T13 shows contents of the image abnormality type T12 and shows information to specify the type of image abnormality.

The parts table T2 is a table showing information of how to determine the target part which is the cause of the image abnormality from among the parts in the image forming apparatus 1. The parts table T2 shown in FIG. 4B is a table in which the image abnormality type corresponds to the "periodic white spot/black spot" and actually, the parts table T2 is prepared for each type of image abnormality. The parts table T2 includes the following items, number T21, target part T22, and abnormal determination method T23.

The number T21 shows identification information of the record of the parts table T2. The target part T22 shows the target parts which cause the image abnormality in the image forming apparatus 1 corresponding to the number T21. The target part T22 shown in FIG. 4B include the following parts which correspond to periodic white spot/black spot as the image abnormality type, for example, the photoreceptor drum 413, the developer 412, the intermediate transfer belt 421, the secondary transfer belt 432, the primary transfer roller 422, the secondary transfer roller Up 423A, the secondary transfer roller Lw 431A, the supporting roller 423 as the intermediate transfer roller, the fixing belt 61, the fixing roller 63, and the pressuring roller 64.

The abnormality determination method T23 shows information describing how the image abnormality is judged to specify the target part T22. The abnormality determination method T23 shown in FIG. 4B shows information regarding the cycle and the condition of occurrence for an abnormal portion such as white spots/black spots in the abnormal image in order to specify the target part T22 corresponding to the "periodic white spot/black spot" as the image abnormality type.

As shown in FIG. 4C, the test diagnosis table T3 is the table showing information of the test diagnosis corresponding to the part as the cause for the image abnormality which occurred. The test diagnosis is a diagnosis to obtain the abnormality of the part and improvement percentage of the image abnormality to calculate the degree of deterioration (test diagnosis improvement percentage). The test diagnosis table T3 includes the following items, number T31, image abnormality type T32, and test diagnosis method T33. The number T31 shows identification information of the record of the test diagnosis table T3. The image abnormality type T32 shows a type of image abnormality corresponding to the number T31. The test diagnosis method T33 shows information of the specific test diagnosis method on the parts corresponding to the image abnormality type T32.

The image abnormality type T32 is set for each part. As for "Output test chart with changed parameter and confirm degree of improvement" in the test diagnosis method T33, the type of parameter and the amount of change is different for each part as the target of the test diagnosis. For example, when the part shown in the image abnormality type T32 is a part in the fixer 60, the parameter to be changed can be fixing temperature, and when the part shown in the image abnormality type T32 is a part in the charger 414, the parameter can be charged voltage.

The test diagnosis table T3 shown in FIG. 4C corresponds to the image abnormality but it is not limited to the above. The test diagnosis table T3 can be prepared for abnormalities other than the image abnormality (sheet default, trouble occurrence). In the test diagnosis table T3 for an abnormality other than the image abnormality, the image abnormality type T32 is changed to the abnormality type T32 showing the type of abnormality other than the image abnormality, the test diagnosis method T33 corresponding to the abnormality type T32 includes the target part of the test diagnosis and the contents of the test diagnosis method.

Figure 5:
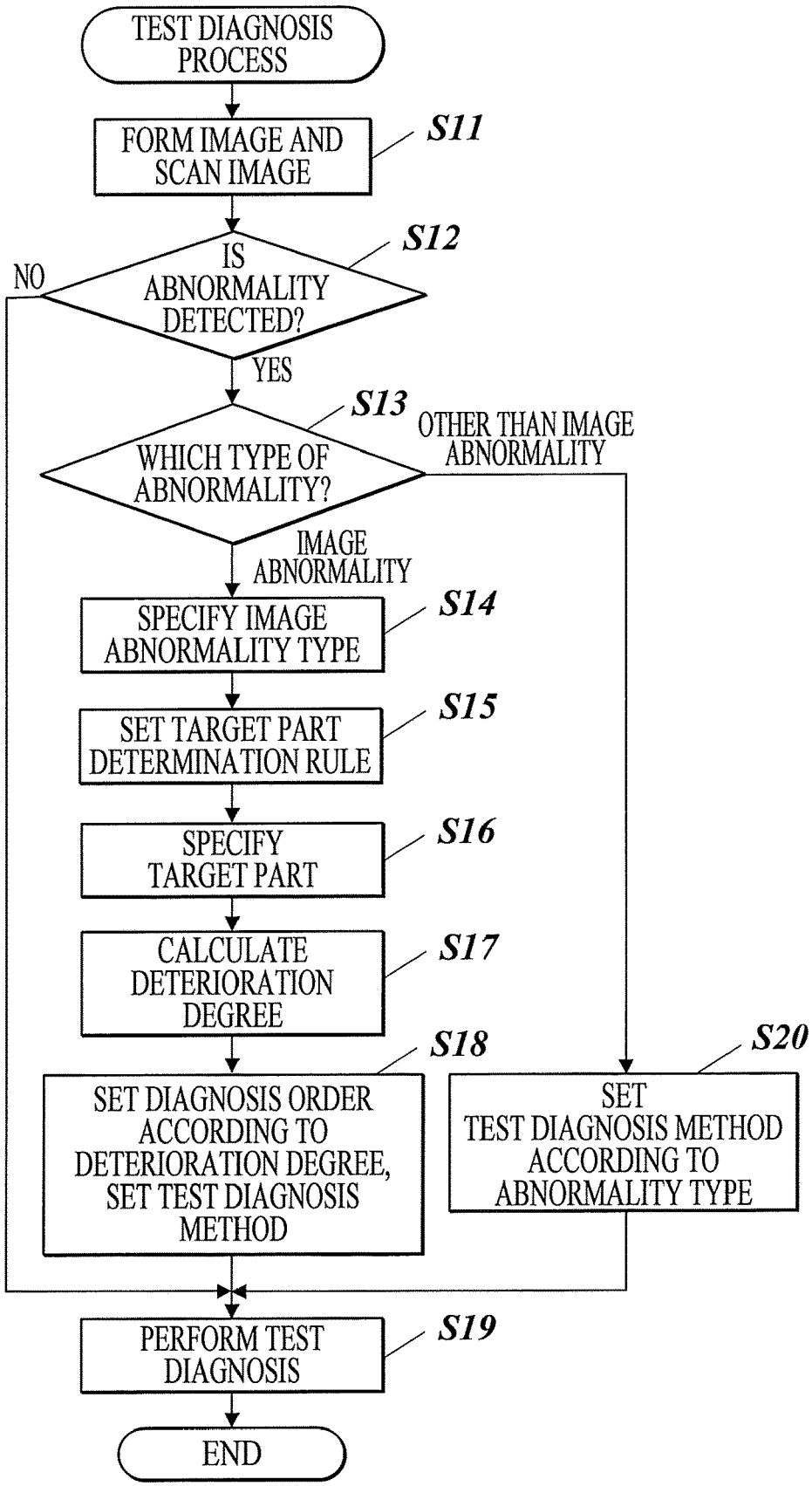
FIG. 5 is a flowchart showing a test diagnosis process.

Next, with reference to FIG. 5 and FIG. 6, the operation of the image forming apparatus 1 is described. FIG. 5 is a flowchart showing a test diagnosis process. FIG. 6 is a diagram showing a table of an example of the order of diagnosis of the parts in a diagnosis according to the present embodiment.

The test diagnosis process performed in the image forming apparatus 1 is described with reference to FIG. 5. For example, according to the image forming apparatus 1, when the user inputs the instruction to execute the test diagnosis process on the operation/display unit 20, this triggers the image control CPU 11 to perform the test diagnosis process according to the test diagnosis program stored in the nonvolatile memory 12.

First, the image control CPU 11 controls the parts in the image forming apparatus main body 100 such as the sheet feeder 50, the image former 40, the fixer 60, and the sheet conveyor 70 so that the test chart (background color is one color (gray, white, etc.)) set in advance is formed as an image on the sheet S, the image formed on the sheet S by the image forming apparatus 200 is scanned (read), and the image data of the scanned image is obtained (step S11). The sheet S scanned in step S11 is ejected from, for example, a finisher FN.

Then, the image control CPU 11 analyzes the image data read in step S11, detects the abnormality in image forming based on the image analysis result, sensed information from a sensing unit (voltmeter, thermometer, jam sensing unit, particle counter of toner, etc. (all not shown)) of the image forming apparatus 1, and whether an error occurred, and determines whether there is an abnormality when the image is formed (step S12). When there is no abnormality (step S12; NO), the test diagnosis process ends.

When there is an abnormality (step S12; YES), the image control CPU 11 refers to the image abnormality table T1 stored in the nonvolatile memory 12 and determines whether the type of the abnormality determined as occurring in step S12 is the image abnormality described in the image abnormality type T12 with contents as described in the abnormality contents T13 (step S13). When it is considered to be the image abnormality (step S13: image abnormality), the image control CPU 11 refers to the image abnormality table T1 and specifies the type for the image abnormality determined as occurring in step S13 (step S14).

Then, the image control CPU 11 refers to the parts table T2 which is stored in the nonvolatile memory 12 and which corresponds to the type of image abnormality specified in step S14 and sets the determination rule of the target parts by the abnormality determination method T23 (step S15). Then, according to the determination rule of the target parts set in step S15, the image control CPU 11 specifies to which record of the abnormality determination method T23 the image abnormality in the image analyzed in step S12 belongs, and specifies the target part T22 corresponding to the record (step S16).

For example, in step S16, when the type of image abnormality is "periodic white spot/black spot", the cycle of the white spot/black spot in the FD direction obtained in step S12 is measured. The cycle of the white spot/black spot includes the distance between sheets S. As shown in the parts table T2 in FIG. 4B, since there are close cycles in the cycles described in the abnormal determining method T23, it is preferable that all of the target parts T22 of the record with measured cycles close to the cycles described in the abnormality determination method T23 are specified. For example, when the measured cycle is 100 mm, as all of the target parts T22 corresponding to the cycles in the abnormality determination method T23 within the pre-set predetermined range (±20 mm) from the measured cycle, the following three are specified, secondary transfer roller Up 423A, secondary transfer roller Lw 431A, supporting roller (intermediate transfer roller) 423. The above predetermined range can be changed according to operation from the user on the operation/display unit 20 (for example, ±50 mm)

Then, regarding the target parts specified in step S16, the image control CPU 11 reads from the nonvolatile memory 12 or calculates the following as the coefficient for the degree of deterioration, test diagnosis improvement percentage A, count value counting use of the part, limit value, trouble occurring count C, and trouble occurring coefficient D. The image control CPU 11 calculates the deterioration degree X showing degree of deterioration of the target parts according to the following formula (1) using the test diagnosis improvement percentage A, target part wear percentage B, trouble occurring count C, and trouble occurring coefficient D obtained above (step S17).

$$X=A*B+C*D \quad (1)$$

In the above formula, the test diagnosis improvement percentage A is the improvement percentage of the abnormal image when the parameters are changed in the test diagnosis (MAX: 1.00), the target part wear percentage B is the count value/limit value of the target part, trouble occurring count C is the number of times that trouble (trouble code (service call, error code such as jam code)) relating to the target part occurred, and trouble occurring coefficient D is coefficient according to trouble code type (0.00 to 1.00). The trouble code is the identification information showing type of trouble.

Regarding the test diagnosis improvement percentage A, the test diagnosis improvement percentage A according to the change in the parameter for each target part obtained in the test diagnosis performed in later-described step S19 is stored in the nonvolatile memory 12. In step S17, the test diagnosis improvement percentage A of the test diagnosis previously performed for the target part is read and obtained from the nonvolatile memory 12.

Regarding the target part wear percentage B, the image forming apparatus 1 stores the count value which shows the number of times each part in the apparatus is used and the limit value of use in the nonvolatile memory 12, and increments the count value according to the use of the parts. In step S17, the count value and the limit value of the target part is read from the nonvolatile memory 12, and the target part wear percentage B is calculated and obtained using the read count value and the limit value. For example, when the count value is 80000 for a target part with the limit value 100000, the target part wear percentage B is 0.8.

Regarding the trouble occurring count C, the image forming apparatus 1 stores the number of times the trouble code relating to each part in the apparatus occurs in the nonvolatile memory 12. In step S17, the number of times that the trouble code occurred for the target part is read and obtained as the trouble occurring count C.

Regarding the trouble occurring coefficient D, the trouble occurring coefficient is set in advance according to the type of trouble code of each part in the apparatus, and the image forming apparatus 1 stores the trouble occurring coefficient in the nonvolatile memory 12. If the part needs to be exchanged immediately by fixing the trouble, the value of the deterioration degree X can be made higher by setting the trouble occurring coefficient D to a value close to 1.00. In step S17, the trouble occurring coefficient D of the trouble corresponding to the trouble occurring count C for the target part is read and obtained.

Then, the image control CPU 11 stores (overwrites) in the nonvolatile memory 12 the deterioration degree X of the target part calculated in step S17, and sets the diagnosis order in the order from the parts as the diagnostic target with the high deterioration degree X. The CPU 11 refers to the test diagnosis table T3 stored in the nonvolatile memory 12, and sets the test diagnosis method T33 corresponding to the image abnormality type T32 of the target part (step S18).

The image control CPU 11 performs the test diagnosis of the target part specified in step S16 according to the diagnosis order and the test diagnosis method set in step S18 and displays the test diagnosis result on the operation/display unit 20 (step S19). With this, the test diagnosis process ends. In step S19, the following test diagnosis is performed at least once, the parameter is changed, the image is formed on the sheet by the image former 40 and the fixer 60, the image formed on the sheet is read by the image reading apparatus 200, and the image of the read image data is analyzed to determine whether the image abnormality is improved. It is determined whether the target part is the reason for the image abnormality according to whether the image abnormality is finally improved by changing the parameter. When the test diagnosis of the target part is performed and the image abnormality is not improved at all even if the parameter is changed, the target part is diagnosed as the non-target part which is not the cause for the image abnormality. When the test diagnosis of the target part is performed and the image abnormality is completely improved by changing the parameter, the target part is diagnosed as not having any problems and that the image abnormality is caused only due to the parameter setting. When the test diagnosis of the target part is performed and there is a change in the image data after the parameter is changed but the image abnormality is not improved, the target part is diagnosed as the part as the cause for the image abnormality and is diagnosed as the target of exchange.

Further, in step S19, the image control CPU 11 calculates the test diagnosis improvement percentage A of the target part showing how much the image abnormality is improved when the parameter is changed and the value is stored (overwritten) in the nonvolatile memory 12.

When the abnormality is not the image abnormality (step S13: other than image abnormality), the image control CPU 11 refers to the test diagnosis table T3 which is stored in the nonvolatile memory 12 and which corresponds to the abnormality (sheet defect, trouble occurrence) other than the image abnormality determined in step S13, and sets the test diagnosis method T33 of the target part corresponding to the abnormality type T32 (step S20) and advances the process to step S19. In step S19 after step S20, the image control CPU 11 performs the test diagnosis method of the parts set in step S20.

For example, when the test diagnosis process is performed, as shown in the table in FIG. 6, the type of image abnormality is specified in step S14, the target part is specified in step S16, the degree of deterioration corresponding to each part specified in step S17 is calculated, and the diagnosis order of each part specified in step S18 is set. The diagnosis order is set in the order that the deterioration degree is large. Therefore, the test diagnosis is performed from the secondary transfer roller Up 423A which has a high deterioration degree such that the possibility of abnormal diagnosis is high. Then, the secondary transfer roller Up 423A is diagnosed as abnormal. Therefore, according to the test diagnosis process of the present embodiment, the time necessary until the abnormal part is specified is shortened compared to conventional configurations such as the table in FIG. 7B.

According to the present embodiment, the image forming apparatus 1 includes a plurality of types of parts and the image is formed on the sheet using the plurality of parts. The image forming apparatus 1 includes the image former 40 and the fixer 60 which form the image on the sheet, and the image reading apparatus 200 which reads the image data of the sheet on which the image is formed. The image forming apparatus 1 also includes an image control CPU 11. The image control CPU 11 detects the image abnormality from the read image data, specifies the target part of the diagnosis from the plurality of parts based on the detected image abnormality, calculates the deterioration degree X of the specified target part, and diagnoses whether the detected image abnormality is caused by the target part based on the calculated deterioration degree X.

Therefore, by diagnosing with priority the part with a high deterioration degree X and with a high possibility as being the cause of the image abnormality, the time necessary to find the part which causes the image abnormality can be shortened.

The image control CPU 11 diagnoses the target part in order from the target part in which the calculated deterioration degree X is high. Therefore, the parts are diagnosed in an order putting priority on the parts with high deterioration degree X, and the time necessary to find the part which causes the image abnormality can be shortened.

The image control CPU 11 specifies the part as the target of diagnosis from the plurality of parts based on the type of detected image abnormality. Therefore, the part suitable for the diagnosis corresponding to the type of image abnormality can be extracted.

The image control CPU 11 diagnoses the specified target part based on the diagnosis method corresponding to the type of detected image abnormality. Therefore, the target part can be diagnosed by the suitable diagnosis method corresponding to the type of image abnormality.

The image control CPU 11 diagnoses the target part based on the diagnosis method corresponding to the specified target part. Therefore, the target part can be diagnosed by the suitable diagnosis method corresponding to the target part.

The image control CPU 11 calculates the deterioration degree X of the target part using the trouble occurring count C which is the history information of how many times the abnormality occurred in the specified target part. Therefore, the suitable deterioration degree X can be calculated by reflecting the history of the number of times that the abnormality occurred in the target part.

The image control CPU 11 calculates the target part wear percentage B which is the count value with relation to the limit value of use of the specified target part and calculates the deterioration degree X of the target part based on the calculated target part wear percentage B. Therefore, the suitable deterioration degree X reflecting the wear percentage of the target part up to the present can be calculated.

The image control CPU 11 changes the parameter of the specified target part to diagnose whether the detected image abnormality is improved. Therefore, when the image abnormality is improved, the target part can be controlled under the parameters used when the image abnormality improved, and the image can be formed normally.

The image control CPU 11 uses the test diagnosis improvement percentage A showing the percentage that the detected image abnormality is improved by changing the parameter of the specified target part. With this, the image control CPU 11 calculates the deterioration degree X of the target part. Therefore, the suitable deterioration degree X reflecting the diagnosis improvement percentage A of the target part can be calculated, and the target part with the high improvement percentage can be diagnosed with priority.

The description according to the present embodiment is one example of the preferable image forming apparatus and the recording medium according to the present invention, and the present invention is not limited to the above.

For example, according to the present embodiment, the image forming apparatus 1 forms the color image using toners consisting of four colors YMCK, but the present invention is not limited to the above. For example, the image forming apparatus 1 can form a monochrome image using black toner.

The detailed configuration and the detailed operation of the image forming apparatus 1 according to the present embodiment can be suitably changed without leaving the scope of the present invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-007168 filed on Jan. 19, 2018 is incorporated herein by reference in its entirety.

What is claimed is:

1. An image forming apparatus which includes a plurality of types of parts, and which forms an image on a sheet using the plurality of parts, the apparatus comprising:

an image former which forms the image on the sheet;

an image reader which reads image data of the sheet on which the image is formed; and a hardware processor which detects an image abnormality from the read image data, specifies a target part for diagnosis from the plurality of parts based on the detected image abnormality, calculates a deterioration degree of the specified target part, and diagnoses whether the specified target part is a cause for the detected image abnormality based on the calculated deterioration degree.

2. The image forming apparatus according to claim 1, wherein the hardware processor diagnoses the target part in order from the target part in which the calculated deterioration degree is high.

3. The image forming apparatus according to claim 1, wherein the hardware processor specifies the target part for diagnosis from the plurality of parts based on a type of the detected image abnormality.

4. The image forming apparatus according to claim 1, wherein the hardware processor diagnoses the specified target part based on a diagnosis method corresponding to a type of the detected image abnormality.

5. The image forming apparatus according to claim 4, wherein the hardware processor diagnoses the specified target part based on the diagnosis method corresponding to the specified target part.

6. The image forming apparatus according to claim 1, wherein the hardware processor calculates a target wear percentage which is a count value with relation to a limit value of use for the specified target part, and calculates the deterioration degree of the specified target part based on the calculated target part wear percentage.

7. The image forming apparatus according to claim 1, wherein the hardware processor calculates the deterioration degree of the specified target part using history information showing a number of times the abnormality occurred in the specified target part.

8. The image forming apparatus according to claim 1, wherein the hardware processor changes a parameter of the specified target part to diagnose whether the detected image abnormality is improved.

9. The image forming apparatus according to claim 8, wherein the hardware processor calculates the deterioration degree of the specified target part using a diagnosis improvement percentage showing a percentage that the detected image abnormality improved by changing a parameter of the specified target part.

10. A non-transitory computer-readable recording medium having a program stored thereon for controlling a computer used in an image forming apparatus which includes a plurality of types of parts, and which forms an image on a sheet using the plurality of parts, the program controlling the computer to function as:

an image former which forms the image on the sheet;

an image reader which reads image data of the sheet on which the image is formed; and a hardware processor which detects an image abnormality from the read image data, specifies a target part for diagnosis from the plurality of parts based on the detected image abnormality, calculates a deterioration degree of the specified target part, and diagnoses whether the specified target part is a cause for the detected image abnormality based on the calculated deterioration degree.

* * * * *